US010954939B2

(12) United States Patent
Lundin

(10) Patent No.: US 10,954,939 B2
(45) Date of Patent: Mar. 23, 2021

(54) GEAR PUMPS

(71) Applicant: Cytiva Sweden AB, Uppsala (SE)

(72) Inventor: Andreas Torbjorn Lundin, Uppsala (SE)

(73) Assignee: Cytiva Sweden AB, Uppsala (SE)

( * ) Notice: Subject to any disclaimer, the term of this patent is extended or adjusted under 35 U.S.C. 154(b) by 219 days.

(21) Appl. No.: 15/769,818

(22) PCT Filed: Oct. 28, 2016

(86) PCT No.: PCT/EP2016/076149

§ 371 (c)(1),
(2) Date: Apr. 20, 2018

(87) PCT Pub. No.: WO2017/072331

PCT Pub. Date: May 4, 2017

(65) Prior Publication Data

US 2019/0145405 A1 May 16, 2019

(30) Foreign Application Priority Data

Oct. 30, 2015 (GB) ..... 1519239
Nov. 20, 2015 (GB) ..... 1520452

(51) Int. Cl.
*F04C 2/08* (2006.01)
*F04C 15/00* (2006.01)
*F04C 2/18* (2006.01)

(52) U.S. Cl.
CPC ..... *F04C 2/084* (2013.01); *F04C 2/18* (2013.01); *F04C 15/0019* (2013.01); *F04C 2240/20* (2013.01); *F05C 2225/00* (2013.01)

(58) Field of Classification Search
CPC .. F04C 2/084; F04C 2250/20; F04C 2240/20; F04C 15/0019; F05C 2225/00
See application file for complete search history.

(56) References Cited

U.S. PATENT DOCUMENTS 820,789 A 5/1906 Hutchins
2,833,224 A 5/1958 Meyer et al.
(Continued)

FOREIGN PATENT DOCUMENTS

DE 3707722 A1 9/1988
DE 102006018285 A1 10/2007
(Continued)

OTHER PUBLICATIONS

Machine translation of German Patent Publication DE 102012212827 A1, Inventor: Sutter, Published Jan. 23, 2014. (Year: 2014).*
(Continued)

*Primary Examiner* — Mary Davis
(74) *Attorney, Agent, or Firm* — Eversheds Sutherland (US) LLP

(57) ABSTRACT

Disclosed is a gear pump (10) comprising a contra rotating gear element pair (30 and 40) mounted within a housing (20), each gear element having complementary gear teeth sets providing a pumping action in use, said teeth being formed from an annulus (34 and 44) of generally rigid construction mounted on a relatively flexible inner section (35 and 45), the gear pair being mounted such that their respective annuli are biased into resilient contact with the housing to provide a sliding seal.

8 Claims, 3 Drawing Sheets

(56) References Cited

U.S. PATENT DOCUMENTS

| | | | | |
|---|---|---|---|---|
| 3,304,795 | A | 2/1967 | Rouverol | |
| 4,912,998 | A * | 4/1990 | Sugano | F16H 57/023 74/409 |
| 5,163,824 | A | 11/1992 | Kantner | |
| 6,361,289 | B1 * | 3/2002 | Hennes | F04C 2/084 417/310 |
| 9,920,761 | B2 * | 3/2018 | Schofield | F04C 2/084 |
| 2013/0216417 | A1 * | 8/2013 | Dixon | F04C 2/084 418/143 |
| 2014/0056746 | A1 | 2/2014 | Flavelle | |

FOREIGN PATENT DOCUMENTS

| | | | |
|---|---|---|---|
| DE | 102006034386 | A1 | 1/2008 |
| DE | 102012207079 | A1 | 10/2013 |
| DE | 102012212827 | A1 | 1/2014 |
| GB | 2114701 | A | 8/1983 |
| GB | 2115875 | A | 9/1983 |
| JP | S5720580 | A | 2/1982 |
| JP | S6368783 | A | 3/1988 |

OTHER PUBLICATIONS

PCT International Search Report and Written Opinion for PCT Application No. PCT/EP2016/076149 dated Jan. 17, 2017 (12 pages).
GB Search Report for GB Application No. 1519239.6 dated Feb. 10, 2016 (4 page).

* cited by examiner

GEAR PUMPS

CROSS REFERENCE TO RELATED APPLICATIONS

This application claims the priority benefit of PCT/EP2016/076149 filed on Oct. 28, 2016 which claims priority benefit of Great Britain Application Nos. 1519239.6 and 1520452.2 filed Oct. 30 and Nov. 20, 2015, respectively. The entire contents of which are hereby incorporated by reference herein.

FIELD OF THE INVENTION

The present invention relates to gear pumps of the type that have two cooperating toothed elements which provide a fluid pressure change in a fluid circuit.

BACKGROUND OF THE INVENTION

Gear pumps of different designs are employed, usually for pumping higher viscosity fluids such as hydraulic fluid or machine oil. Common arrangements use either two contra rotating toothed parts such as spur gears having gear teeth extending radially outwardly (an external gear pump) or one toothed part such as a spur gear having external teeth and one ring gear having inwardly extending teeth complementary to, but more numerous than the external teeth of the spur gear (internal gear pump) where the spur gear and ring gear rotate in the same direction.

To function with long life and reliability, the parts of gear pumps are made with clearances (gaps) so they operate with as little friction as possible. The clearances used inherently reduce efficiency because pressurised fluid leaks back through the gaps created by the clearance during operation. To counter this leak back, better quality gear pumps are produced with close tolerances, and consequently are more costly to produce. Even with reduced clearance of parts there is a loss of efficiency. Rigid parts are used to increase service life and to maintain the close tolerance even under significant pressure differentials in the pump.

The inventor of the present invention has found that gear pumps have practical advantages in fluidic circuits used for bioprocessing apparatus, because they can be used to provide a wide range of fluid flow rates and a wide range of pressures, if needed, for example 1-1000 l/h. However, it was envisaged that cleaning of the gear pumps would be a problem. With increasing use of disposable small scale bioprocessing apparatus, cleaning is not an issue because the parts can be disposed of rather than cleaned. However, high efficiency pumps, ideally with close tolerance parts, are preferred in these applications; but conversely, the disposable nature of the apparatus requires low cost parts. Thus far, these two competing product features have proved difficult to reconcile.

Herein, embodiments of a low cost but high efficiency gear pump are described and illustrated which is particularly suitable for the needs of disposable small scale bioprocessing apparatus.

SUMMARY OF THE INVENTION

The invention provides a gear pump arrangement according to claim 1 having preferred features defined by claims dependent on claim 1. The invention provides also a disposable small scale bioprocessing apparatus employing the gear pump of claim 1.

Accordingly, the invention, in one aspect provides a gear pump comprising a housing supporting first and second gear elements having complementary teeth or other projections cooperable to provide a pressure differential in a fluid circuit by means of rotation of the first and second gear elements, the first, or the first and second elements being arranged in the pump for resilient contact of its/their teeth with the housing to provide sliding sealing contact between the teeth and the housing in use, wherein the first and/or second gear elements include a relatively rigid outer portion forming at least a portion of said teeth or other projections, and an inner relatively more flexible section between the outer portion and a centre of rotation of the or each gear element.

The invention extends to any combination of features disclosed herein, whether or not such a combination is mentioned explicitly herein. Further, where two or more features are mentioned in combination, it is intended that such features may be claimed separately without extending the scope of the invention.

BRIEF DESCRIPTION OF THE DRAWINGS

The invention can be put into effect in numerous ways, illustrative embodiments of which are described below with reference to the drawings, wherein:

The invention, together with its objects and the advantages thereof, may be understood better by reference to the following description taken in conjunction with the accompanying drawings, in which like reference numerals identify like elements in the Figures.

Referring to FIG. 1, there is shown a gear pump 10, including a housing 20, a toothed first drive gear element 30 mounted on a drive shaft 32, a complementary toothed second idler gear element mounted on an idler shaft 42, a pump inlet 50 and a pump outlet 60. The drive gear element 30 is in use driven in the direction of arrow 31, by a motor or the like (not shown). That rotation rotates the teeth set 34 of the gear element 30 to rotate and drive the teeth set 44 of the idler gear element 40 to rotate in the opposite direction indicated by arrow 41. The motion of the gears in turn causes fluid within the housing 20 to be sucked into the inlet 50, and forced out of the outlet 60 with a direction of flow indicated by the remaining arrows of FIG. 1.

Figure 1:
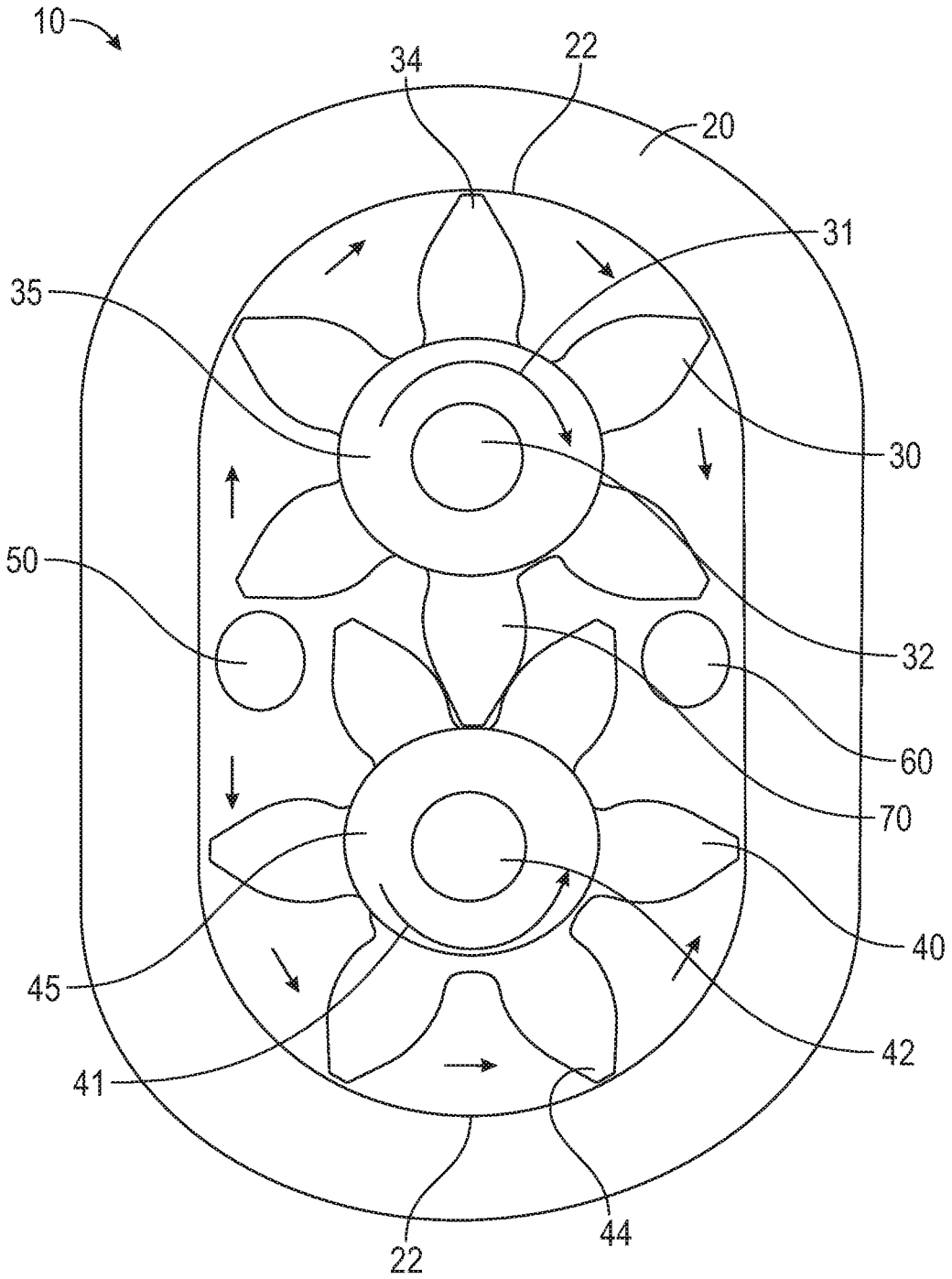
FIG. 1 shows schematically a first embodiment of a gear pump.

The detailed description in the paragraph above is conventional. However, in this pump both gear elements have teeth sets 34 and 44 mounted on an elastomeric boss 35 and 45 respectively. By design, the teeth 34 and 44 are a mutual interference fit, resulting in resilient contact between the respective teeth sets. In addition, the clearance between the housing and the teeth sets is such that the teeth sets are in resilient sliding contact with an inner wall of the housing at least at regions 22 of the wall, opposite to the region 70 of said teeth set contact. This resilient contact inhibits back leakage of fluid in the pump and thereby improves efficiency, without significantly increasing the drive torque required to operate the pump. The sliding contact at regions 22 is such that at least one tooth of each tooth set is in contact at all times, thereby minimising back flow leakage.

Figure 2A:
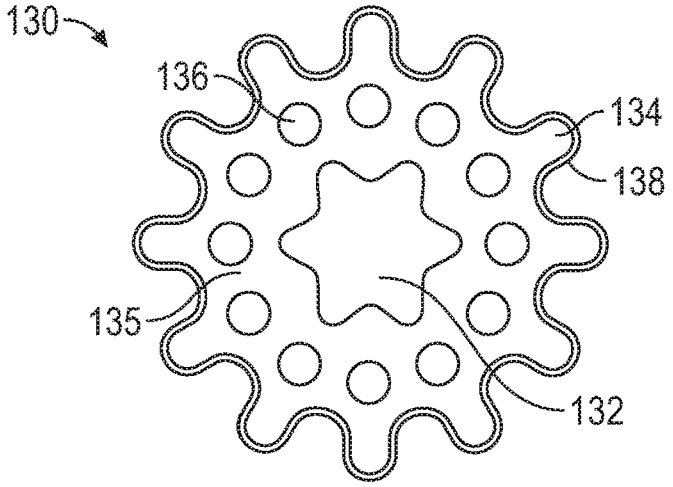
FIGS. 2*a*, 2*b* and 2*c* each show an alternative gear element for use in a gear pump.
Figure 2B:
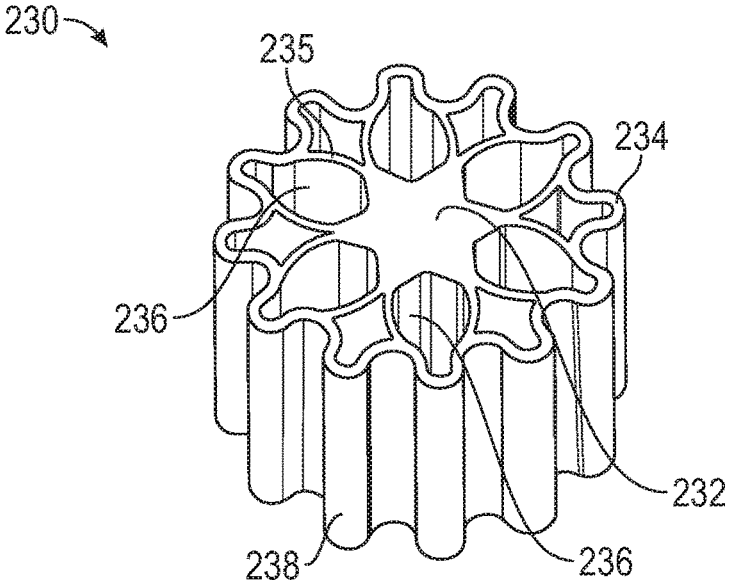
Figure 2C:
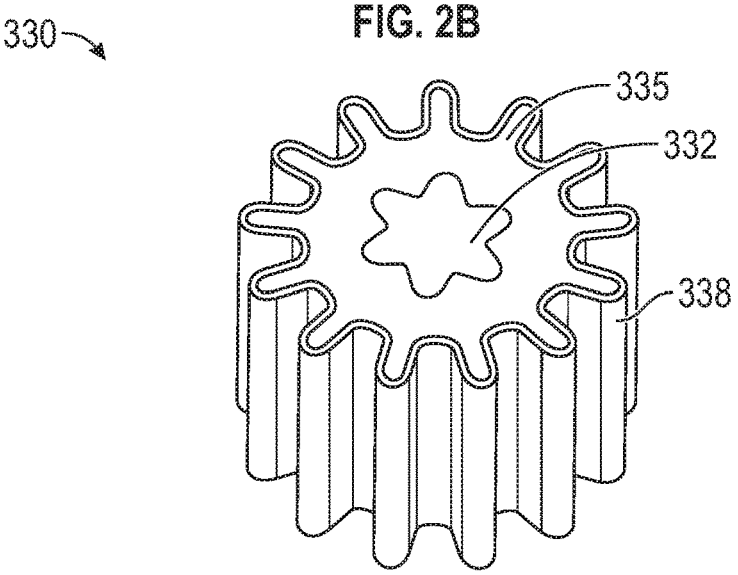

FIGS. 2*a*, 2*b* and 2*c* show an alternative gear elements 130, 230 and 330 which can be used in place of gear element 30 and 40 shown in FIG. 1.

In FIG. 2*a*, the gear 130 is formed from a central star shaped drive shaft 132 (if the gear is the drive gear), covered by an inner section formed from a resilient elastomeric boss 135 which includes voids 136 to improve flexibility, and an outer shell 138 which is shaped with rounded teeth 134. Since the annulus or shell 138 is generally rigid, in interference assembly next to similar gear, the shell 138 will be forced into resilient sliding contact at the housing at the wall regions 22 identified in FIG. 1. The rigid shell can be formed from metals such as stainless steel or plastics such as PTFE or PEEK for improved wear resistance and improved rigidity under pressure loading in use.

In FIG. 2*b* the gear 230 is formed from a unitary plastics moulding comprising a central drive boss 232, an inner section formed from flexible spokes 235, numbering twelve in this case, formed by voids 236, and a relatively rigid outer annular teeth form 238 defining a tooth set of generally rounded shape cooperable with a similarly shaped gear element. The gear element 230 will function in a similar manner to the gear elements 130, 30 and 40, except that resilient deformation results in this instance from elastic bending of the spokes 235.

FIG. 2*c* shows yet another gear element alternative 330. In this embodiment, the gear element 330 comprises a central drive boss 332, surrounded by an inner elastomeric core section 335, and an outer annulus or shell 338 defining a tooth set of involute profile for cooperation with a similarly shaped tooth set of a similar gear element shape. The gear element 330 will function in a similar manner to the gear elements 130 described above.

Figure 3:
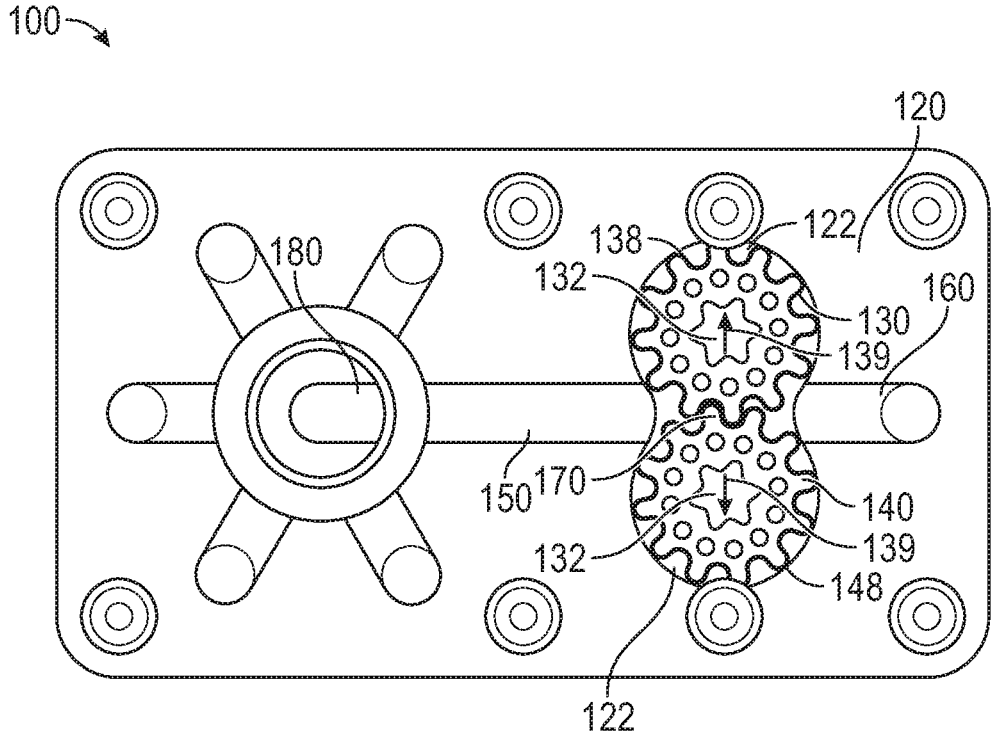
FIG. 3 shows a single use disposable bioprocessing unit.

FIG. 3 shows a single use disposable bioprocessing unit 100, including a fluid path selection valve 180 and a pair of the gear elements 130 and 140 mounted in the apparatus providing a fluid pump 110 having an inlet 150 and an outlet 160. In practice the upper gear 130 is driven by a motor and the lower gear 140 idles, i.e. it is in turn driven by gear 130. A pump housing 120 has inner wall regions 122 at which the teeth 138 of the gear elements make sliding contact, as result of being resiliently forced into that contact by their mutual contact with their opposing gear's teeth. In other words, the teeth sets 138 of each gear are pushed in the direction of arrows 139 respectively leaving their drive bosses in place.

Figure 4:
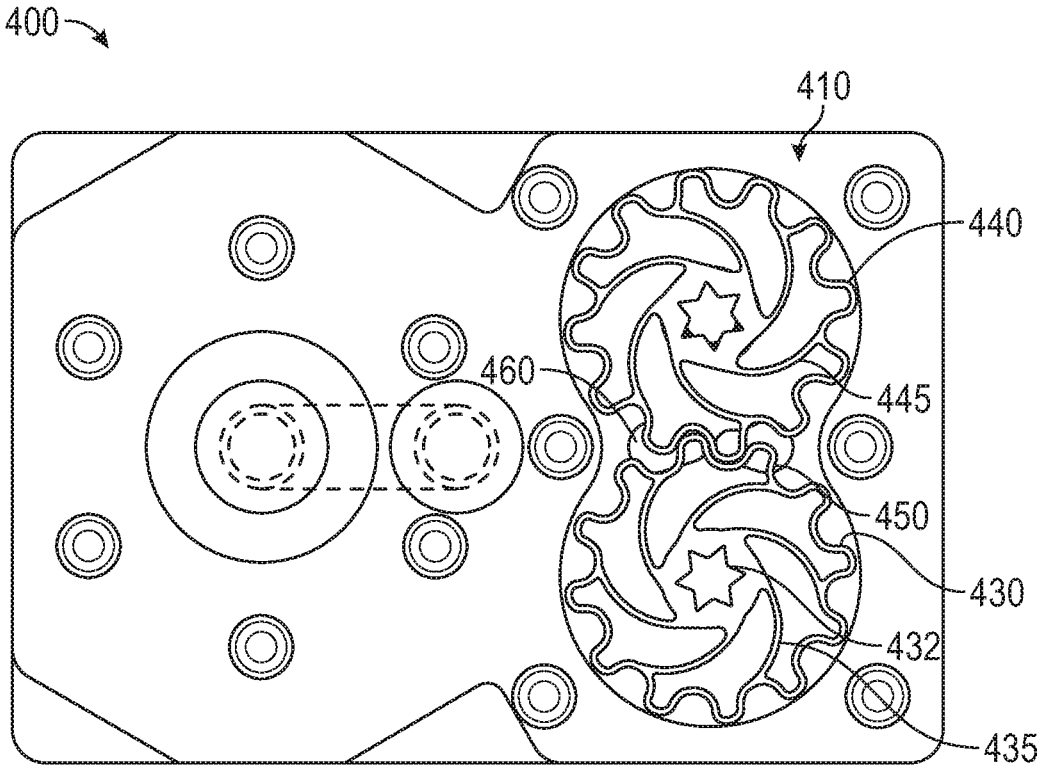
FIG. 4 shows another single use disposable bioprocessing unit.

FIG. 4 shows yet another single use disposable bioprocessing unit 400, having a gear pump 410 comprising a further pair of gear elements 430 and 440. Gear elements 430 and 440 are formed from moulded plastics, and have backwardly swept spokes 435 and 445 respectively, but otherwise function in a similar manner as the gear element described above. In practice gear 440 will turn clockwise, and gear 430 will turn counter-clockwise, such that fluid is drawn into inlet 450 and is expelled under pressure out of outlet 460. In experimentation the pump shown achieved a flow rate of 470 l/h at 2500 rpm speed with 6.2 Bar pressure difference and a flow rate of 1350 l/h at 3000 rpm with 1.4 Bar pressure. Thus a wide range of flow rates is achievable with this construction.

Although embodiments have been described and illustrated, it will be apparent to the skilled addressee that additions, omissions and modifications are possible to those embodiments without departing from the scope of the invention claimed. For example, external gear pumps have being described and illustrated, but internal gear pumps could be employed. Flow directions and orientations have been described, but the gear but pump be used in any orientation and, with the exception of gear elements 430 and 440 (which are unidirectional in view of the swept spokes) can operate in either direction, so can provide flow in a reverse direction if needed. An important aspect of this invention is that the gear teeth described make sealing contact with a portion of the housing where fluid flows in use. This can be achieved as described by forcing the gears toward the housing as a result of their mutual contact, or by virtue of their positioning on their respective shafts in the housing such that biasing force is exerted by the shaft acting on the gear, without significant biasing force resulting from the gear's mutual contact. In other words, the reaction force of the sliding contact force is taken by the gear's shafts. Another alternative is to bias the housing, or a portion of the housing toward the gears, for example by making the housing flexible, for example a flexible shell structure. In that latter case the gears can be made rigid or semi-rigid.

In practice, gears which provide lower cost alternatives are preferred for single use operation, i.e. those constructions and materials described above in relation to the figures. However, since numerous constructions of the gears having a core and relatively more rigid outer teeth, protrusions, or the like, have been described above, for clarity those constructions are summarised here along with other useful alternatives. Examples of core materials are: —elastomer; polymer; fibre filled polymer/elastomer; foamed polymer/elastomer; metal; and metallic depositions. Examples of teeth etc. materials are: —polymers; metals; metallic depositions; and ceramics. Combinations of those materials are envisaged.

Examples of gear constructions are:—

1) a completely solid construction with a rigid/more rigid shell, e.g. formed from a denser grade of material on the outside, e.g. a plate finished shell around a foamed core formed in a mould during a foaming process; a heat, light or chemical surface hardening of a solid material; a rigid shell filled with a settable material such as elastomer, setting or thermosetting polymer, or 2) a construction which is not solid, i.e. a construction which has open areas such as the spaces formed by spokes, holes or open voids or a inner reduced thickness construction, where the non-solid construction is formed either from the same material throughout, but relying on the inherent greater elastic flexibility of the material adjacent the open areas, e.g. formed by chemical etching, electroforming, abrasion, cutting, forging, punching, stamping, machining, laser cutting/ablation, a layered construction (e.g. so called 3D printing) or laminates; or different materials mentioned above, relying on the inherent different flexibility of the different materials. Examples of constructions which are not solid are: is a rigid shell co-moulded with a flexible polymer core such as a rubberised plastics material; a spring steel shell with spokes formed from spring steel also. It is possible to make one driven gear only in the manner described above, with a different construction for the passive (undriven) gear. The passive gear could be formed as an outer shell with no inner formation because it will be kept substantially in place within the housing.

The invention claimed is:

1. A gear pump comprising:

a housing supporting first and second gear elements having complementary teeth or other projections cooperable to provide a pressure differential in a fluid circuit by means of rotation of the first and second gear elements, wherein at least one of the first and second gear elements is arranged in the pump for resilient contact of the respective teeth of the at least one of the first and second gear elements with the housing to provide sliding sealing contact between the teeth and the housing in use, wherein at least one of the first and second gear elements includes a rigid outer portion forming at least a portion of said teeth or other projections, and an inner more flexible section between the outer portion and a center of rotation of the respective at least one of the first and second gear elements, and wherein said first and second gear elements are contra-rotating elements, wherein the teeth of both the first and second gear elements come together in use in resilient contact, and wherein said resilient contact between the first and second gear elements forces the gears in resilient contact with the housing.

2. The gear pump as claimed in claim 1, wherein the inner flexible section is formed from one or more of: flexible spokes; continuous elastomeric material; elastomeric material, foamed material and voids in the elastomeric material.

3. The gear pump as claimed in claim 2, wherein, where said inner section is formed from flexible spokes, said spokes are swept backwards in relation to the intended direction of rotation of the spokes.

4. The gear pump as claimed in claim 1, wherein said housing includes a portion curved towards one or more of the first and second gear elements to provide resilient contact.

5. Single use bioprocessing apparatus including a gear pump as claimed in claim 1.

6. The gear pump as claimed in claim 1, wherein the first and second gear elements are each mounted on an elastomeric boss.

7. A gear pump comprising:

a contra rotating gear element pair mounted within a housing, wherein each gear element has complementary gear teeth sets providing a pumping action in use, said teeth being formed from an annulus of rigid construction mounted on a flexible inner section, and wherein the contra rotating gear element pair is arranged such that the contact between each contra rotating gear element forces the opposing contra rotating gear element into resilient contact with the housing to provide a sliding seal with the housing, and wherein respective bosses of each contra rotating gear element remain in place.

8. A gear pump comprising:

a contra rotating gear element pair comprising two gears mounted within a housing, wherein each gear element has complementary gear teeth sets providing a pumping action in use, said teeth being formed from an annulus of rigid construction mounted on a flexible inner section, wherein the first gear is a drive gear and the second gear is an idler gear, wherein the housing has a region in contact with one or both of the two gears of the contra rotating gear element pair, said region curved to make contact with the respective gear element of the contra rotating gear element pair to provide a sliding seal, and wherein the contact between the two gears of the contra rotating gear element pair elements forces one or both of the contra rotating gear element pair gears in resilient contact with the housing.

* * * * *